US007570107B2

(12) United States Patent
Kim et al.

(10) Patent No.: US 7,570,107 B2
(45) Date of Patent: Aug. 4, 2009

(54) BAND-GAP REFERENCE VOLTAGE GENERATOR

(75) Inventors: Se Jun Kim, Icheon-si (KR); Chun Seok Jeong, Icheon-si (KR)

(73) Assignee: Hynix Semiconductor Inc., Icheon-si (KR)

( * ) Notice: Subject to any disclaimer, the term of this patent is extended or adjusted under 35 U.S.C. 154(b) by 0 days.

(21) Appl. No.: 11/648,462

(22) Filed: Dec. 28, 2006

(65) Prior Publication Data

US 2008/0042737 A1 Feb. 21, 2008

(30) Foreign Application Priority Data

Jun. 30, 2006 (KR) ..... 10-2006-0061488

(51) Int. Cl.
*G05F 1/10* (2006.01)
*G05F 3/02* (2006.01)

(52) U.S. Cl. ..... 327/539; 327/538; 327/540; 323/313

(58) Field of Classification Search ..... 327/538, 327/539, 543; 323/313
See application file for complete search history.

(56) References Cited

U.S. PATENT DOCUMENTS

| | | | | |
|---|---|---|---|---|
| 5,666,046 | A * | 9/1997 | Mietus | 323/313 |
| 6,563,371 | B2 * | 5/2003 | Buckley et al. | 327/539 |
| 6,906,581 | B2 * | 6/2005 | Kang et al. | 327/539 |
| 7,084,698 | B2 | 8/2006 | Kahn et al. | |
| 2004/0155700 | A1 * | 8/2004 | Gower et al. | 327/543 |
| 2005/0206443 | A1 * | 9/2005 | Chatal et al. | 327/538 |
| 2005/0285666 | A1 * | 12/2005 | Garlapati et al. | 327/539 |

* cited by examiner

*Primary Examiner*—Kenneth B Wells
*Assistant Examiner*—John W Poos
(74) *Attorney, Agent, or Firm*—John P. White; Cooper & Dunham LLP

(57) ABSTRACT

A band-gap reference voltage generator is provided that is capable of being used at low voltage simultaneously with adjusting a reference voltage.

12 Claims, 3 Drawing Sheets

BAND-GAP REFERENCE VOLTAGE GENERATOR

TECHNICAL FIELD

The present disclosure relates to a band-gap reference voltage generator, and more particularly to a band-gap reference voltage generator capable of being used at low voltage simultaneously with adjusting a reference voltage.

DESCRIPTION OF THE RELATED ART

Generally, a band-gap reference voltage generator is designed to stably provide a constant or preferred voltage irrespective of a variation of temperature or external voltage. Such a band-gap reference voltage generator is widely used for a semiconductor memory device or other application devices requiring a reference voltage such as a thermal sensor of an On-Die thermometer.

The above-mentioned band-gap reference voltage generator generates a reference voltage $V_{REF}$ by adding a voltage $V_{BE}$ of a Voltage$_{Base\text{-}Emitter}$ ($V_{BE}$) generator, for constantly providing a predetermined diode voltage by performing a diode-connection to a bipolar transistor, and a voltage $V_T$ of a thermal voltage ($V_T$) generator which is capable of generating a voltage proportional to a constant "KT" (where K=Boltzman constant and T=absolute temperature) by generating a $V_{BE}$ difference between two bipolar transistors, such that it minimizes a temperature coefficient using the equation denoted by $V_{REF}=V_{BE}+KV_T$.

In this case, the unique voltage ($V_{BE}$) generator has a negative temperature coefficient of −1.8 mV/° C., and the thermal voltage ($V_T$) generator has a positive(+) temperature coefficient of 0.082 mV/° C.

Therefore, the unique voltage ($V_{BE}$) generator and the thermal voltage ($V_T$) generator have temperature coefficients opposite to each other. If the unique voltage ($V_{BE}$) generator and the thermal voltage ($V_T$) generator search for an absolute temperature associate with a reference voltage which is constant relative a variation of temperature, and calculates a reference voltage ($V_{REF}$) using the absolute temperature, the reference voltage ($V_{REF}$) may be set to about 1.25V. Provided that the reference voltage ($V_{REF}$) is almost equal to a band-gap voltage of silicon (Si), it should be noted that the device associated with the reference voltage ($V_{REF}$) is referred to as a band-gap reference voltage generator.

FIG. 1 is a circuit diagram illustrating a conventional band-gap reference voltage generator.

Referring to FIG. 1, the conventional band-gap reference voltage generator includes a $V_{BE}$ reference voltage generator 11 and a $V_T$ reference voltage generator 12. The $V_{BE}$ reference voltage generator 11 has a negative temperature coefficient (i.e., −1.8 mV/° C. ). The $V_T$ reference voltage generator 12 has a positive(+) temperature coefficient of 0.082 mV/° C.

The conventional band-gap reference voltage generator shown in FIG. 1 further includes a comparator 13 and a PMOS transistor MP1. The comparator 13 compares an output signal of the $V_{BE}$ reference voltage generator 11 with an output signal of the $V_T$ reference voltage generator 12. The PMOS transistor MP1 provides a power-supply voltage (VDD) to the $V_{BE}$ reference voltage generator 11 and $V_T$ reference voltage generator 12.

By the above-mentioned circuit configuration, a current flowing in a diode-connected bipolar transistor and a voltage different as between both ends can be represented by the following equation 1:

$$I \cong I_s \cdot e^{q \cdot V_f / k \cdot T} \quad V_f \cong V_T \cdot \ln \frac{I}{I_s} \qquad \text{[Equation 1]}$$

The $V_a$-node voltage and the $V_b$-node voltage of FIG. 1 implements an equation denoted by $V_a=V_b$, such that a voltage dVf between both ends of a resistor R3 can be represented by the following equation 2:

$$dV_f = V_{f1} - V_{f2} = V_T \cdot \ln\left(\frac{N \cdot R2}{R1}\right) \qquad \text{[Equation 2]}$$

Therefore, a reference voltage of a band-gap circuit can be represented by the following equation 3:

$$V_{ref} = V_{f1} + \frac{R2}{R3} \cdot dV_f = V_{f1} + \frac{R2}{R3} \cdot \ln\left(\frac{N \cdot R2}{R1}\right) \cdot V_T \qquad \text{[Equation 3]}$$

In other words, a rate of variation based on temperature of the voltage $V_{f1}$ is −1.8 mV/° C., and a rate of variation based on temperature of the voltage $V_T$ is 0.082 mV/° C., such that a coefficient of (R2/R3)ln(NR2/R1) of Equation 3 is adjusted to provide a reference voltage insensitive to temperature variation. The above-mentioned reference voltage corresponds to a Si (Silicon) band-gap, and has a value of about 1.25V.

However, the conventional band-gap reference voltage generator produces a reference voltage using the sum of a PTAT (Proportional To Absolute Temperature) voltage and a CTAT (Complementary proportional To Absolute Temperature) voltage, such that it is difficult to normally operate the circuit at low operation voltage equal to or less than a reference voltage (i.e., 1.25V).

There is a need for a band-gap reference voltage generator capable of being used at low voltage simultaneously with adjusting a reference voltage.

SUMMARY

In accordance with one aspect of the present disclosure, a band-gap reference voltage generator is provided which comprises a first reference current generator including a unique-voltage generator for generating a base-emitter unique voltage having a negative temperature coefficient; a thermal voltage generator for generating a thermal voltage having a positive temperature coefficient, and a driver for generating a first reference current in response to a first voltage signal generated by comparison of the unique voltage and the thermal voltage, a second reference current generator including a driver for generating a second reference current in response to a second voltage signal generated by comparison of a division voltage of a power-supply voltage and the unique voltage, and a reference voltage generator including a driver for forming a current mirror in association with each of the first reference current generator and the second reference current generator, and generating a third reference current and a fourth reference current via the formed current mirrors, and a current-voltage converter for adding the third reference current and the fourth reference current, converting the sum of the third reference current and the fourth reference current into a reference voltage, and outputting the reference voltage.

Preferably, the first reference current generator includes a base-emitter unique voltage generator which is diode-connected to a bipolar transistor, and generates a constant diode voltage when receiving the power-supply voltage, a thermal voltage generator for generating a $V_{BE}$ difference between two bipolar transistors, and generating a thermal voltage proportional to a specific constant KT (where K=Boltzman constant and T=absolute temperature) when receiving the power-supply voltage, a comparator for comparing an output voltage of the base-emitter unique voltage generator with an output voltage of the thermal voltage generator, amplifying a difference between the output voltage of the base-emitter unique voltage generator and the output voltage of the thermal voltage generator, and outputting the amplified result, a first driver for transmitting the power-supply voltage to the thermal voltage generator in response to the output signal of the comparator, and generating the first reference current, and a second driver for transmitting the power-supply voltage to the unique-voltage generator in response to the output signal of the comparator. The first driver and the second driver form a current mirror.

Preferably, the base-emitter unique voltage generator is diode-connected to the bipolar transistor to receive the power-supply voltage via the second driver.

Preferably, the thermal voltage generator connects a resistor for receiving the power-supply voltage via the first driver to the diode-connected bipolar transistor in the form of a series connection.

Preferably, the comparator includes an operational amplifier (OP-amp) configured to compare the base-emitter unique voltage of the unique voltage generator with the thermal voltage of the thermal voltage generator, amplify a difference between the base-emitter unique voltage and the thermal voltage, and output the amplified result to the current mirror.

Preferably, the OP-amp receives the base-emitter unique voltage as an inverting(−) signal, and receives the thermal voltage as a non-inverting(+) signal.

Preferably, the second driver generates a current signal having a multiple relation in association with the first reference current.

Preferably, the first driver and the second driver are PMOS transistors, respectively.

Preferably, the second reference current generator includes a voltage divider for performing division of the power-supply voltage, a comparator for comparing the division voltage of the voltage divider with the unique voltage, amplifying a difference between the division voltage and the unique voltage, and outputting the amplified result, and a third driver for transmitting the power-supply voltage to the voltage divider in response to an output signal of the comparator, and generating the second reference current.

Preferably, the voltage divider includes a resistor configured to receive the power-supply voltage via the third driver.

Preferably, the comparator includes an OP-amp for comparing the division voltage with the unique voltage, amplifying a difference between the division voltage and the unique voltage, and outputting the amplified result to the third driver.

Preferably, the OP-amp receives the base-emitter unique voltage as an inverting(−) signal, and receives the division voltage as a non-inverting(+) signal.

Preferably, the third driver is a PMOS transistor.

Preferably, the reference voltage generator includes a fifth driver for providing the power-supply voltage in response to an output signal of a comparator of the first reference current generator, forming a current mirror in association with a first driver, and generating a third reference current which has a multiple relation in association with the first reference current, a fourth driver for providing the power-supply voltage in response to an output signal of a comparator of the second reference current generator, forming a current mirror in association with a third driver of the second reference current generator, and generating the fourth reference current which has a multiple relation in association with the second reference current, and a current-voltage converter for adding the third reference current of the fifth driver and the fourth reference current of the fourth driver, converting the sum of the third reference current and the fourth reference current into a reference voltage, and outputting the reference voltage.

Preferably, the fourth driver and the fifth driver are composed of PMOS transistors, respectively.

Preferably, the current-voltage converter includes a resistor configured to receive the power-supply voltage via the fourth driver and the fifth driver, and convert the sum of the third reference current generated from the fifth driver which forms the current mirror in association with the first driver, and the fourth reference current generated from the fourth driver which forms the current mirror in association with the third driver, into the reference voltage.

As described above, the band-gap reference voltage generator according to the subject matter of the present disclosure converts the sum of $I_{PTAT}$ signal (where PTAT is a Proportional To Absolute Temperature) and $I_{CTAT}$ signal (where CTAT is a Complementary proportional To Absolute Temperature) into a voltage via a resistor, and generates a reference voltage. Therefore, the band-gap reference voltage generator has no limitation in its operation voltage, and can properly adjust a desired reference voltage via resistance.

BRIEF DESCRIPTION OF THE DRAWINGS

The above-mentioned and other features and advantages of the subject matter of the present disclosure will be more clearly understood from the following detailed description taken in conjunction with the accompanying drawings, in which.

DESCRIPTION OF THE PREFERRED EMBODIMENTS

Figure 1:
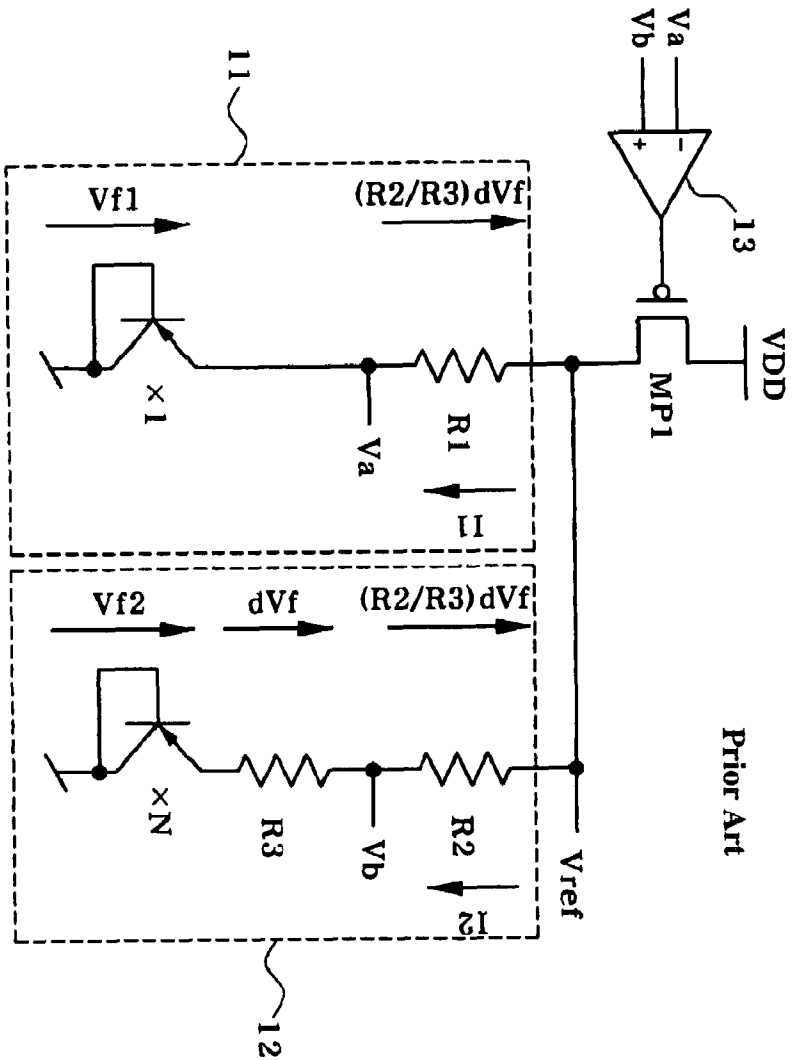
FIG. 1 is a circuit diagram illustrating a conventional band-gap reference voltage generator.

Now, preferred embodiments of the present disclosure will be described in detail with reference to the annexed drawings. In the drawings, the same or similar elements are denoted by the same reference numerals even though they are depicted in different drawings. In the following description, a detailed description of known functions and configurations incorporated herein will be omitted when it may make the subject matter of the present disclosure rather unclear.

Figure 2:
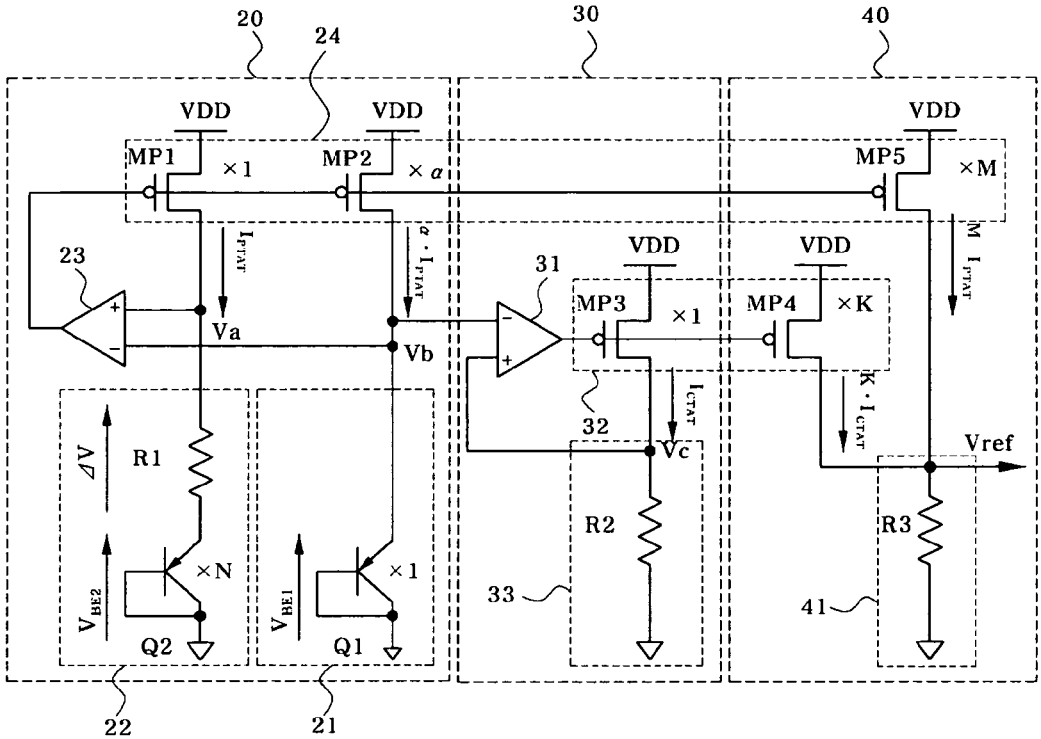
FIG. 2 is a circuit diagram illustrating a band-gap reference voltage generator according to an exemplary embodiment of the present disclosure.

FIG. 2 is a circuit diagram illustrating a band-gap reference voltage generator according to a preferred embodiment of the present disclosure.

Referring to FIG. 2, the band-gap reference voltage generator includes a first reference current generator 20, a second reference current generator 30, and a reference voltage generator 40.

The first reference current generator 20 includes a unique-voltage generator 21, a thermal voltage generator 22, and a driver MP1.

The unique-voltage generator 21 generates a base-emitter unique voltage having a negative temperature coefficient. The thermal voltage generator 22 generates a thermal voltage having a positive temperature coefficient. The driver MP1 generates a first reference current ($I_{PTAT}$) in response to a first voltage signal generated by the comparison/amplification of the unique voltage and the thermal voltage.

The second reference current generator 30 includes a driver MP3, which generates a second reference current ($I_{CTAT}$) in response to a second voltage signal generated by the comparison/amplification of a division voltage of a power-supply voltage (VDD) and the unique voltage.

The reference voltage generator 40 includes a driver, which forms a current mirror in association with each of the first reference current generator 20 and the second reference current generator 30, and generates a third reference current ($M \cdot I_{PTAT}$) and a fourth reference current ($K \cdot I_{CTAT}$) via the formed current mirrors. The reference voltage generator 40 includes a current-voltage converter 41, which adds the third reference current ($M \cdot I_{PTAT}$) and the fourth reference current ($K \cdot I_{CTAT}$), converts the sum of the third reference current ($M \cdot I_{PTAT}$) and the fourth reference current ($K \cdot I_{CTAT}$) into a reference voltage, and outputs the reference voltage.

The first reference current generator 20 includes a base-emitter unique voltage generator 21, a thermal voltage generator 22, a comparator 23, a first driver MP1, and a second driver MP2. The base-emitter unique voltage generator 21 diode-connected to a bipolar transistor Q1 generates a constant diode voltage when receiving a power-supply voltage (VDD). The thermal voltage generator 22 generates a $V_{BE}$ difference between two bipolar transistors Q1 and Q2, and generates a thermal voltage ($V_T$: Va-node voltage) proportional to a specific constant KT (where K=Boltzman constant and T=absolute temperature) when receiving the power-supply voltage (VDD). The comparator 23 compares an output voltage of the base-emitter unique voltage generator 21 with an output voltage of the thermal voltage generator 22, amplifies a difference between the output voltage of the base-emitter unique voltage generator 21 and the output voltage of the thermal voltage generator 22, and outputs the amplified result. The first driver MP1 transmits a power-supply voltage (VDD) to the thermal voltage generator 22 in response to the output signal of the comparator 23, and generates the first reference current ($I_{PTAT}$). The second driver MP2 transmits the power-supply voltage (VDD) to the unique-voltage generator 21 in response to the output signal of the comparator 23. In this case, it should be noted that the first driver MP1 and the second driver MP2 form a current mirror.

The base-emitter unique-voltage generator 21 is diode-connected to the bipolar transistor Q1 for receiving the power-supply voltage (VDD) via the second driver MP2.

The thermal voltage generator 22 connects a resistor R1 for receiving the power-supply voltage (VDD) via the first driver MP1 to the diode-connected bipolar transistor Q1 in the form of a series connection.

The comparator 23 includes an operational amplifier (OP-amp) 23 capable of comparing a base-emitter unique voltage ($V_{BE1}$) with the thermal voltage ($V_T$) of the thermal voltage generator 22, amplifying a difference between the base-emitter unique voltage ($V_{BE1}$) and the thermal voltage ($V_T$), and outputting the amplified result to the current mirror 24. In this case, the OP-amp 23 receives the base-emitter unique voltage ($V_{BE}$) as an inverting(−) signal, and receives the thermal voltage ($V_T$) as a non-inverting(+) signal.

The current mirror 24 includes a first driver MP1 and a second driver MP2. The first driver (MP1) transmits the power-supply voltage (VDD) to the thermal voltage generator 22 in response to the output signal of the comparator 23, and generates a first reference current ($I_{PTAT}$). The second driver MP2 forms a current mirror in association with the first driver MP1, and transmits the power-supply voltage (VDD) to the unique-voltage generator 21 in response to the output signal of the comparator 23, and has a multiple relation in association with the first reference current ($I_{PTAT}$).

Each of the first and second drivers MP1 and MP2 is composed of a PMOS transistor.

The second reference current generator 30 includes a voltage divider 33, a comparator 31, and a third driver MP3. The voltage divider 33 performs division of the power-supply voltage (VDD). The comparator 31 compares the division voltage of the voltage divider 33 with the unique voltage ($V_{BE1}$), amplifies a difference between the division voltage and the unique voltage ($V_{BE1}$), and outputs the amplified result. The third driver MP3 transmits the power-supply voltage (VDD) to the voltage divider 33 in response to an output signal of the comparator 31, and generates a second reference current ($I_{CTAT}$).

The voltage divider 33 includes a resistor R2 for receiving the power-supply voltage (VDD) via the third driver MP3.

The comparator 31 includes an OP-amp 31, which compares the division voltage (i.e., a V3-node voltage) with the unique voltage ($V_{BE1}$), amplifies a difference between the division voltage and the unique voltage ($V_{BE1}$), and outputs the amplified result to the third driver MP3.

The OP-amp 31 receives a base-emitter unique voltage as an inverting(−) signal, and receives the division voltage as a non-inverting(+) signal. In other words, the OP-amp 31 receives the base-emitter unique voltage at its inverting(−) terminal, and receives the division voltage at its non-inverting (+) terminal.

The third driver MP3 is composed of a PMOS transistor.

The reference voltage generator 40 includes a fifth driver MP5, a fourth driver MP4, and a current-voltage converter 41. The fifth driver MP5 provides a power-supply voltage (VDD) in response to an output signal of the comparator 23 of the first reference current generator 20, forms a current mirror 24 in association with the first driver MP1, and generates a third reference current ($M \cdot I_{PTAT}$) which has a multiple relation in association with the first reference current ($I_{PTAT}$). The fourth driver MP4 provides the power-supply voltage (VDD) in response to an output signal of the comparator 31 of the second reference current generator 30, forms a current mirror 32 in association with the third driver MP3, and generates a fourth reference current ($K \cdot I_{CTAT}$) which has a multiple relation in association with the second reference current ($I_{CTAT}$)

The current-voltage converter 41 adds the third reference current ($M \cdot I_{PTAT}$) of the fifth driver MP5 and the fourth reference current ($K \cdot I_{CTAT}$) of the fourth driver MP4, converts the sum of the third reference current ($M \cdot I_{PTAT}$) and the fourth reference current ($K \cdot I_{CTAT}$) into a reference voltage ($V_{ref}$), and outputs the reference voltage ($V_{ref}$).

The current-voltage converter 41 includes a resistor R3. The resistor R3 receives the power-supply voltage (VDD) via the fourth driver MP4 and the fifth driver MP5, and converts the sum of the third reference current ($M \cdot I_{PTAT}$) generated from the fifth driver MP5 which forms the current mirror 24 in association with the first driver MP1, and the fourth reference current ($K \cdot I_{CTAT}$) generated from the fourth driver MP4 which forms the current mirror 32 in association with the third driver MP3, into the reference voltage ($V_{ref}$).

The fourth driver MP4 and the fifth driver MP4 are composed of PMOS transistors, respectively.

Operations of the above-mentioned band-gap reference voltage generator according to a preferred embodiment of the present disclosure will hereinafter be described.

A unique voltage generator 21 of the first reference current generator 20 generates a constant diode unique voltage ($V_{BE1}$) upon receiving the power-supply voltage (VDD) from a diode-connected bipolar transistor Q1. The thermal voltage generator 22 generates a thermal voltage proportional to an absolute temperature upon receiving the power-supply voltage (VDD) generated by a $V_{BE}$ difference between two bipolar transistors Q1 and Q2.

The comparator 23 compares the unique voltage $V_{BE1}$ (i.e., Vb-node voltage) with the thermal voltage $V_T$ (i.e., V1-node voltage), amplifies a difference between the unique voltage $V_{BE1}$ and the thermal voltage $V_T$, and outputs the amplified result to the first driver MP1.

The first driver MP1 transmits the power-supply voltage (VDD) to the thermal voltage generator 22 in response to the output signal of the comparator 23, such that it generates a first reference current ($I_{PTAT}$). The second driver MP2 capable of forming the current mirror 24 in association with the first driver Mp1 transmits the power-supply voltage (VDD) to the unique voltage generator 21 in response to the output signal of the comparator 23, such that it generates a current ($\alpha \cdot I_{PTAT}$) proportional to the first reference current ($I_{PTAT}$).

In this case, a current signal flowing in the two diode-connected bipolar transistors can be represented by the following equation 4:

$$I_{Q1}=I_S\exp[V_{BE1}/V_T]\ I_{Q2}=N\cdot I_S\exp[V_{BE2}/V_T] \quad \text{[Equation 4]}$$

In this case, $V_T$ is the value of K·T/q proportional to an absolute temperature (T) (where K=Boltzman constant, T=absolute temperature, and q=basic-charge quantity)

Also, the Va-node voltage and the Vb-node voltage are represented by Va=Vb due to the feedback operation of the OP-amp of the comparator 23, such that the first reference current ($I_{PTAT}$) can be represented by the following equation 5:

$$I_{PTAT} = \frac{(V_{BE1} - V_{BE2})}{R_1} = \frac{\ln(N \cdot \alpha) \cdot V_T}{R_1} \quad \text{[Equation 5]}$$

The third driver MP3 of the second reference current generator 30, in response to the output signal of the comparator 31 for comparing the division voltage of the voltage divider 33 with the unique voltage ($V_{BE1}$), amplifying a difference between the division voltage and the unique voltage ($V_{BE1}$), and outputting the amplified result, applies the power-supply voltage (VDD) to the voltage divider 33, and generates the second reference current ($I_{CTAT}$).

The fifth driver MP5 of the reference current generator 40 provides the power-supply voltage (VDD) in response to the output signal of the comparator 23 of the first reference current generator 20, and forms the current mirror 24 in association with the first driver MP1, such that it generates the third reference current ($M \cdot I_{PTAT}$) having a multiple relation in association with the first reference current ($I_{PTAT}$) In this case, the current signal of the fifth driver MP3 is proportional to the current signal of the first driver Mp1, such that the third reference current ($M \cdot I_{PTAT}$) can be represented by the following equation 6:

$$I_5=M\cdot I_1 \quad \text{[Equation 6]}$$

The fourth driver MP4 of the reference current generator 40 provides the power-supply voltage (VDD) in response to the output signal of the second reference current generator 30, and forms the current mirror 32 in association with the third driver MP3, such that it generates the fourth reference current ($K \cdot I_{CTAT}$) having a multiple relation in association with the second reference current ($I_{CTAT}$). In this case, the Vb-node voltage is equal to the Vc-node voltage at the OP-amp of the comparator 31, and the current signal of the fourth driver MP4 is proportional to the current signal of the third driver MP3, such that the fourth reference current ($K \cdot I_{CTAT}$) can be represented by the following equation $$I_4=K\cdot I_3 \quad \text{[Equation 7]}$$

Therefore, the current-voltage converter 41 adds the third reference current ($M \cdot I_{PTAT}$) generated by the current mirror of the fifth driver MP5 to the fourth reference current ($K \cdot I_{CTAT}$) generated by the current mirror of the fourth driver MP4, converts the sum of the third reference current ($M \cdot I_{PTAT}$) and the fourth reference current ($K \cdot I_{CTAT}$) into the reference voltage ($V_{ref}$), and outputs the reference voltage ($V_{ref}$).

In this case, the current signal of the fourth driver MP4 is represented by $K \cdot I_{CTAT}$, and the current signal of the fifth driver MP5 is represented by $M \cdot I_{PTAT}$, such that the reference voltage ($V_{ref}$) can be represented by the following equation 8:

$$V_{ref} = K \cdot \frac{R_3}{R_2} \cdot \left(V_{BE1} + \frac{M \cdot R_2}{K \cdot R_1} \cdot \ln(N \cdot \alpha) \cdot V_T\right) \quad \text{[Equation 8]}$$

In more detail, a variation rate of temperature of the voltage ($V_{BE1}$) is −1.8 mV/° C., and a variation rate of temperature of the voltage $V_T$ is 0.082 mV/° C., such that the reference voltage ($V_{ref}$) can be properly adjusted by not only values of three resistors (R1, R2, and R3) but also three variables (α, M, and K) capable of providing a multiple-relation current ratio to minimize a variation width of a reference potential.

Figure 3:
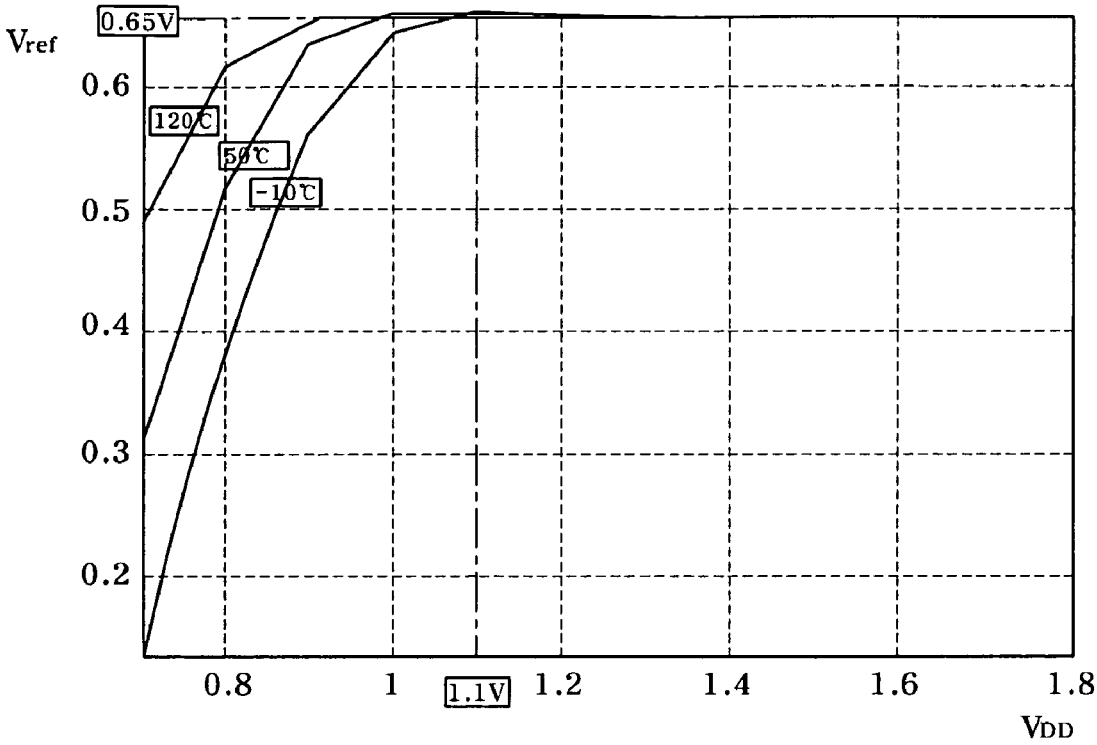
FIG. 3 is a graph illustrating the simulation result of the band-gap reference voltage generator shown in FIG. 2.

FIG. 3 is a graph illustrating the simulation result of the band-gap reference voltage generator shown in FIG. 2.

As can be seen from FIG. 3, the band-gap reference voltage generator stepwise-reduces the power-supply voltage (VDD) in the range from 1.8V to 0.8V, and provides different temperature environments of −10° C., 50° C., and 120° C. under the condition that the above-mentioned power-supply voltage (VDD) is provided. Therefore, the graph of FIG. 3 shows a variation of the reference voltage generated at the above-mentioned temperature environments of −10° C., 50° C., and 120° C.

As a result, as shown in FIG. 3, the reference voltage is always fixed to a specific voltage of 0.65V irrespective of a temperature variation within a VDD-range from 1.1V to 1.8V. In other words, the reference voltage is always constant at 0.65V irrespective of the temperature variation within the VDD-range from 1.1V to 1.8V.

Therefore, the band-gap reference voltage generator according to the present disclosure can normally operate a circuit although the power-supply voltage drops to 1.1V (i.e., a power-supply voltage less than 1.25V acting as a band-gap voltage).

As apparent from the above description, the band-gap reference voltage generator according to the present disclosure generates a reference voltage by converting the sum of the $I_{PTAT}$ signal and the $I_{CTAT}$ signal into a voltage signal via a resistor, such that it can be operated at low voltage, and a desired reference voltage can be properly adjusted via resistance of the resistor.

Therefore, the band-gap reference voltage generator according to the present disclosure can be applied to not only semiconductor memory devices, each of which should be operated at lower voltage to reduce power consumption and generation of heat, but also other application devices requiring the reference voltage.

Although preferred embodiments of the present disclosure have been disclosed for illustrative purposes, those skilled in the art will appreciate that various modifications, additions and substitutions are possible, without departing from the scope and spirit of the disclosure and the accompanying claims.

This patent specification is based on and claims the priority of Korean patent application no. 2006-61488, filed Jun. 30, 2006, the entire contents of which are incorporated by reference herein.

What is claimed is:

1. A band-gap reference voltage generator comprising:

a first reference current generator including:

a unique-voltage generator configured to generate a base-emitter unique voltage having a negative temperature coefficient;

a thermal voltage generator configured to generate a thermal voltage having a positive temperature coefficient; and a first driver configured to generate a first reference current in response to a first voltage signal generated by comparison of the unique voltage and the thermal voltage;

a second reference current generator including a comparator configured to compare a division voltage of a power supply voltage and the unique voltage, and output a second voltage signal; and a second driver configured to generate a second reference current in response to the second voltage signal, wherein the comparator receives the base-emitter unique voltage as an inverting(−) signal, and receives the division voltage as a non-inverting(+) signal; and a reference voltage generator including:

a third driver configured to form a current mirrors in association with each of the first reference current generator and the second reference current generator, respectively, and generate a third reference current and a fourth reference current via said current mirrors; and a current-voltage converter configured to add the third reference current and the fourth reference current, convert the sum of the third reference current and the fourth reference current into a reference voltage, and output the reference voltage;

wherein the first reference current generator further includes:

a base-emitter unique voltage generator diode-connected to a bipolar transistor, and configured to generate a constant diode voltage when receiving a power-supply voltage;

a thermal voltage generator configured to generate a $V_{BE}$ difference between two bipolar transistors, and generate a thermal voltage proportional to a specific constant KT, where K corresponds to Boltzman constant and T corresponds to absolute temperature, when receiving the power-supply voltage;

a comparator configured to compare a first output voltage of the base-emitter unique voltage generator with a second output voltage of the thermal voltage generator, amplify a difference between the first output voltage of the base-emitter unique voltage generator and the second output voltage of the thermal voltage generator, and output the amplified difference;

a fourth driver configured to transmit the power-supply voltage to the thermal voltage generator in response to the amplified difference signal of the comparator, and generate the first reference current; and a fifth driver configured to transmit the power-supply voltage to the unique-voltage generator in response to the output signal of the comparator, wherein the fourth driver and the fifth driver form a current mirror, and wherein the fifth driver generates a current signal having a multiple relation in association with the first reference current generated by the fourth driver.

2. The band-gap reference voltage generator according to claim 1, wherein the base-emitter unique voltage generator is diode-connected to the bipolar transistor for receiving the power-supply voltage via the fifth driver.

3. The band-gap reference voltage generator according to claim 1, wherein the thermal voltage generator connects a resistor for receiving the power-supply voltage via the fourth driver to the diode-connected bipolar transistor in the form of a series connection.

4. The band-gap reference voltage generator according to claim 1, wherein the comparator includes an operational amplifier (OP-amp) configured to compare the base-emitter unique voltage of the unique voltage generator with the thermal voltage of the thermal voltage generator, amplify a difference between the base-emitter unique voltage and the thermal voltage, and output the amplified result to the current mirror.

5. The band-gap reference voltage generator according to claim 4, wherein the OP-amp receives the base-emitter unique voltage as an inverting(−) signal, and receives the thermal voltage as a non-inverting(+) signal.

6. The band-gap reference voltage generator according to claim 1, wherein the fourth driver and the fifth driver are PMOS transistors, respectively.

7. A band-gap reference voltage generator comprising:

a first reference current generator including:

a unique-voltage generator configured to generate a base-emitter unique voltage having a negative temperature coefficient;

a thermal voltage generator configured to generate a thermal voltage having a positive temperature coefficient; and a first driver configured to generate a first reference current in response to a first voltage signal generated by comparison of the unique voltage and the thermal voltage;

a second reference current generator including a comparator configured to compare a division voltage of a power supply voltage and the unique voltage, and output a second voltage signal; and a second driver configured to generate a second reference current in response to the second voltage signal, wherein the comparator receives the base-emitter unique voltage as an inverting(−) signal, and receives the division voltage as a non-inverting(+) signal; and a reference voltage generator including:

a third driver configured to form a current mirrors in association with each of the first reference current generator and the second reference current generator, respectively, and generate a third reference current and a fourth reference current via said current mirrors; and a current-voltage converter configured to add the third reference current and the fourth reference current, convert the sum of the third reference current and the fourth reference current into a reference voltage, and output the reference voltage;

wherein the second reference current generator further includes:

a voltage divider configured to perform division of the power-supply voltage;

a comparator configured to compare the division voltage of the voltage divider with the unique voltage, amplify a difference between the division voltage and the unique voltage, and output the amplified result; and a fourth driver configured to transmit the power-supply voltage to the voltage divider in response to an output signal of the comparator, and generate the second reference current, wherein the fourth driver is a PMOS transistor.

8. The band-gap reference voltage generator according to claim 7, wherein the voltage divider includes a resistor configured to receive the power-supply voltage via the fourth driver.

9. The band-gap reference voltage generator according to claim 7, wherein the comparator includes an OP-amp configured to compare the division voltage with the unique voltage, amplify a difference between the division voltage and the unique voltage, and output the amplified result to the fourth driver.

10. The band-gap reference voltage generator according to claim 9, wherein the OP-amp receives the base-emitter unique voltage as an inverting(−) signal, and receives the division voltage as a non-inverting(+) signal.

11. A band-gap reference voltage generator comprising:

a first reference current generator including:

a unique-voltage generator configured to generate a base-emitter unique voltage having a negative temperature coefficient;

a thermal voltage generator configured to generate a thermal voltage having a positive temperature coefficient; and a first driver configured to generate a first reference current in response to a first voltage signal generated by comparison of the unique voltage and the thermal voltage;

a second reference current generator including a comparator configured to corn p are a division voltage of a power supply voltage and the unique voltage, and output a second voltage signal; and a second driver configured to generate a second reference current in response to the second voltage signal, wherein the comparator receives the base-emitter unique voltage as an inverting(−) signal, and receives the division voltage as a non-inverting(+) signal; and a reference voltage generator including:

a third driver configured to form a current mirrors in association with each of the first reference current generator and the second reference current generator, respectively, and generate a third reference current and a fourth reference current via said current mirrors; and a current-voltage converter configured to add the third reference current and the fourth reference current, convert the sum of the third reference current and the fourth reference current into a reference voltage, and output the reference voltage;

wherein the reference voltage generator includes:

a fourth driver configured to provide the power-supply voltage in response to an output signal of a comparator of the first reference current generator, form a current mirror in association with the first driver, and generate the third reference current which has a multiple relation in association with the first reference current;

a fifth driver configured to provide the power-supply voltage in response to an output signal of a comparator of the second reference current generator, form a current mirror in association with the second driver of the second reference current generator, and generate the fourth reference current which has a multiple relation in association with the second reference current; and a current-voltage converter configured to add the third reference current of the fourth driver and the fourth reference current of the fifth driver, convert the sum of the third reference current and the fourth reference current into a reference voltage, and output the reference voltage, wherein the fourth driver and the fifth driver are cornposed of PMOS transistors, respectively.

12. The band-gap reference voltage generator according to claim 11, wherein the current-voltage converter includes:

a resistor configured to receive the power-supply voltage via the fourth driver and the fifth driver, and convert the sum of the third reference current generated by the fourth driver which forms the current mirror in association with the first driver, and the fourth reference current generated by the fifth driver which forms the current mirror in association with the third driver, into the reference voltage.

* * * * *